US006012826A

United States Patent [19]

Chabert

[11] Patent Number: 6,012,826

[45] Date of Patent: Jan. 11, 2000

[54] ILLUMINATING BALLOON WITH AN INFLATABLE ENVELOPE AND INTEGRATED CONTROL UNIT

[75] Inventor: Pierre Chabert, Saint Martin D'Heres, France

[73] Assignee: Airstar of Zone Artisanale de Champ Fila, Poisat, France

[21] Appl. No.: 08/934,048

[22] Filed: Sep. 19, 1997

[30] Foreign Application Priority Data

Oct. 2, 1996 [FR] France ..... 96 12207

[51] Int. Cl.[7] ..... F21S 1/10; F21V 15/02

[52] U.S. Cl. ..... 362/363; 362/96; 362/267; 362/431; 362/278; 362/376

[58] Field of Search ..... 362/267, 470, 362/276, 96, 431, 363, 278, 253, 376; 244/31, 33, 98, 99

[56] References Cited

U.S. PATENT DOCUMENTS 2,936,366 5/1960 Rainford ..... 240/10

5,083,250 1/1992 Malcolm ..... 362/253

FOREIGN PATENT DOCUMENTS

B1-0 679 413 11/1995 European Pat. Off. .

2 570 049 3/1986 France .

U-84 31 698 6/1986 Germany .

*Primary Examiner*—Sandra O'Shea

*Assistant Examiner*—Marshall Honeyman

*Attorney, Agent, or Firm*—Oliff & Berridge, PLC

[57] ABSTRACT

An illuminating balloon with an inflatable envelope and a control unit integrated in the envelope includes an electropneumatic blowing device having an intake orifice to suck air in from the outside, and a discharge orifice to send the air into the internal space of the balloon, an electronic circuit for power supply of the electropneumatic device and of the bulb, and a cover for support of the bulb and of a protective grid preventing the envelope from coming into contact with the bulb, said grid being extended up to near the top of the envelope from coming into contact with the bulb, said grid being extended up to near the top of the envelope to give the balloon rigidity.

10 Claims, 3 Drawing Sheets

ILLUMINATING BALLOON WITH AN INFLATABLE ENVELOPE AND INTEGRATED CONTROL UNIT

BACKGROUND OF THE INVENTION

The invention relates to an illuminating balloon with an inflatable envelope made of flexible material of small thickness, containing an illuminating device with an electric bulb, first means for supporting and supplying power to the bulb, and second means for filling the envelope with a fluid, notably air, to perform inflation of the balloon.

In illuminating balloons of the prior art (for example as described in the document EP-A-0,697,413), the envelope is airtight and the filling fluid may be air or helium. The electrical power supply to the bulb is generally achieved by means of an electrical enclosure situated at the bottom of a pole. The use of illuminating balloons of this kind in heavy industry or building site environments gives rise to the twofold problem of maintenance of the equipment and safety of people. The balloon envelope is in fact liable to be burst by uncontrolled handling operations. Operation of the pressure switch in case of a drop of the internal pressure automatically cuts the power supply to the bulb. The envelope then has to be repaired for the lighting to be restored, which means that a place must be set aside for storage of spares and repair parts, and also means that the personnel has to be trained. The positioning of the electrical enclosure at the bottom of the pole means that a tightly sealed enclosure meeting safety standards is required, which increases the cost price of the installation.

SUMMARY OF THE INVENTION

The object of the invention is to achieve an inflatable illuminating balloon with maximum reliability and reduced maintenance regardless of the place of use.

The balloon according to the invention is characterized in that:

- the first and second means are arranged in a control unit integrated in the base of the envelope and include:
  - an electropneumatic blowing device having an intake orifice to suck air in from the outside, and a discharge orifice to send the air into the internal space of the balloon,
  - an electronic circuit for power supply of the electropneumatic device and of the bulb,
  - and a cover for support of the bulb and of a protective grid preventing the envelope from coming into contact with the bulb, said grid being extended up to near the top of the envelope to give the balloon rigidity.

The fan of the electropneumatic device runs continuously when the lamp is lit and keeps the envelope in the inflated state even in the case of slight damage caused by accidental or intentional perforation. Integrating all the functions of the control unit in the envelope improves the safety conditions for people.

According to a preferred embodiment, the control unit is mounted on a support plate which fits onto a fixing flange of the envelope, said flange bounding the orifice for insertion of the illuminating device and control unit into the inside of the envelope. The support plate is equipped with a holding leg extending outwards from the envelope in a direction coaxial to the grid, and able to be fitted to a support element, notably a pole.

According to a feature of the invention, the envelope presents an elliptical shape in the inflated state, the cover and grid extending along the minor axis of the envelope.

The electropneumatic device is formed by a suction device or a fan driven by an electric motor put into operation as soon as the electronic circuit is powered on. The electronic circuit is connected by an external cable to the main power supply constituting the normal power supply source, and can be supplied in addition by a backup source, notably an accumulator, arranged inside the cover.

BRIEF DESCRIPTION OF THE DRAWINGS

Other advantages and features will become more clearly apparent from the following description of an embodiment of the invention, given as a non-restrictive example only, and represented in the accompanying drawings in which.

DETAILED DESCRIPTION OF THE PREFERRED EMBODIMENT

Figure 1:
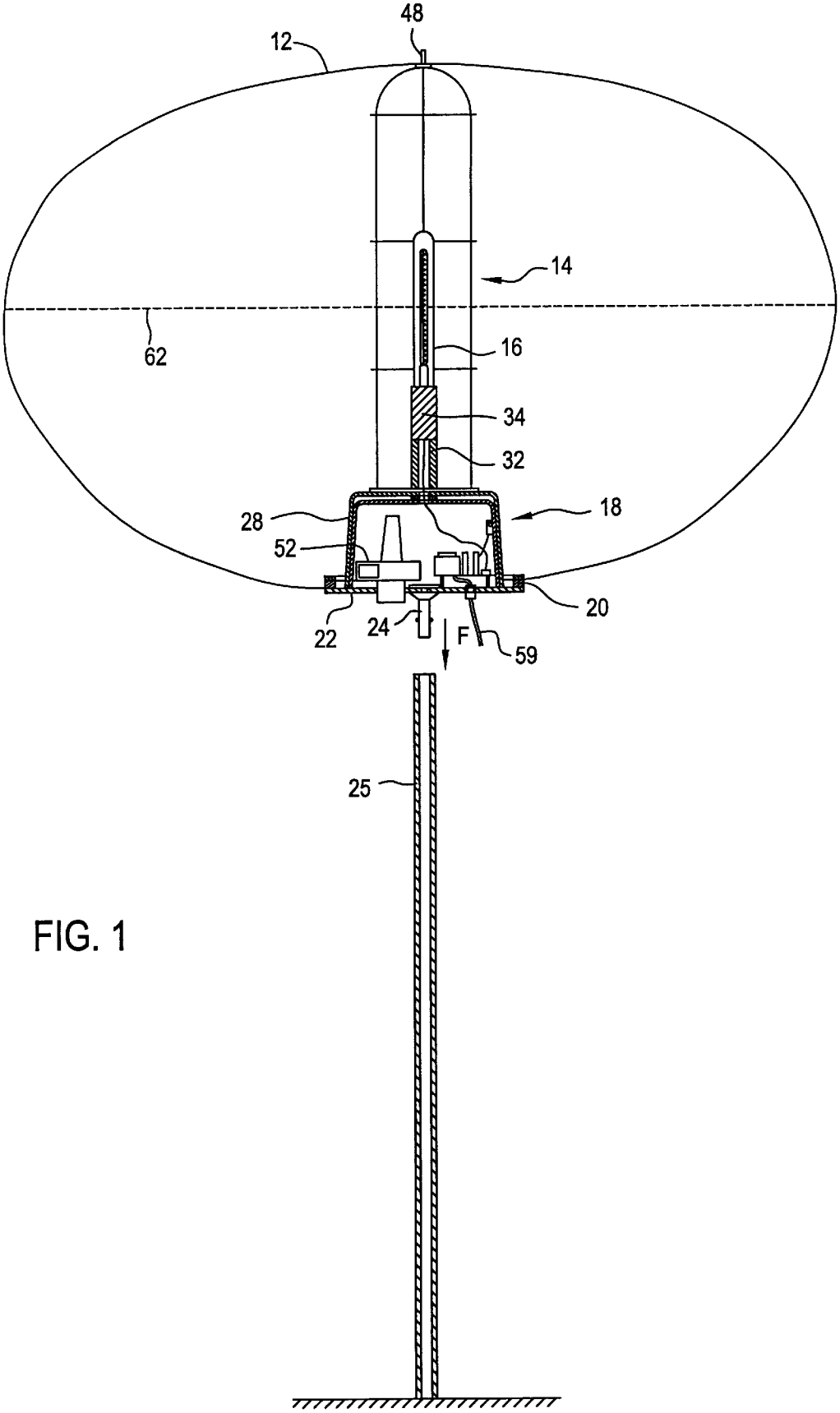
FIG. 1 is a schematic axial sectional view of an illuminating balloon according to the invention, the balloon being represented in the inflated state.
Figure 2:
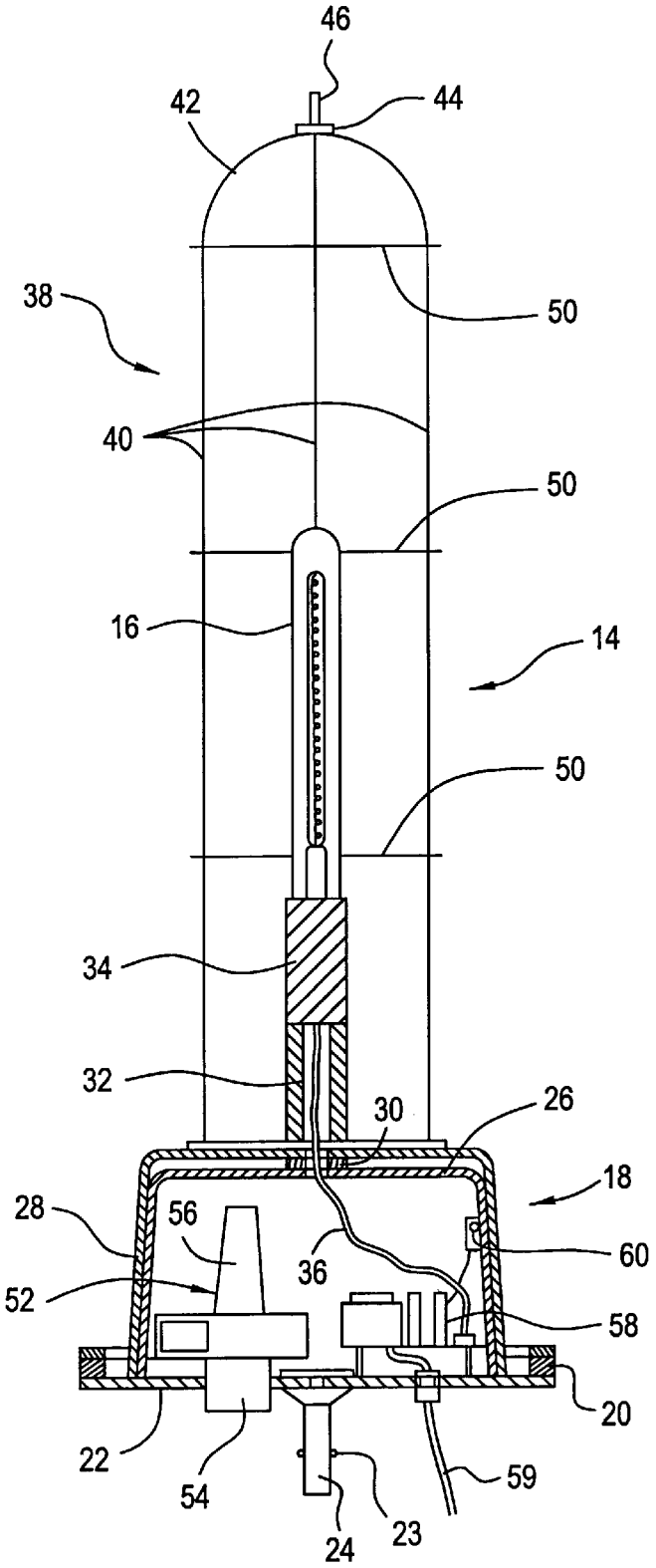
FIG. 2 is a detailed view on an enlarged scale of the active parts of FIG. 1, the envelope and pole not being represented.
Figure 3:
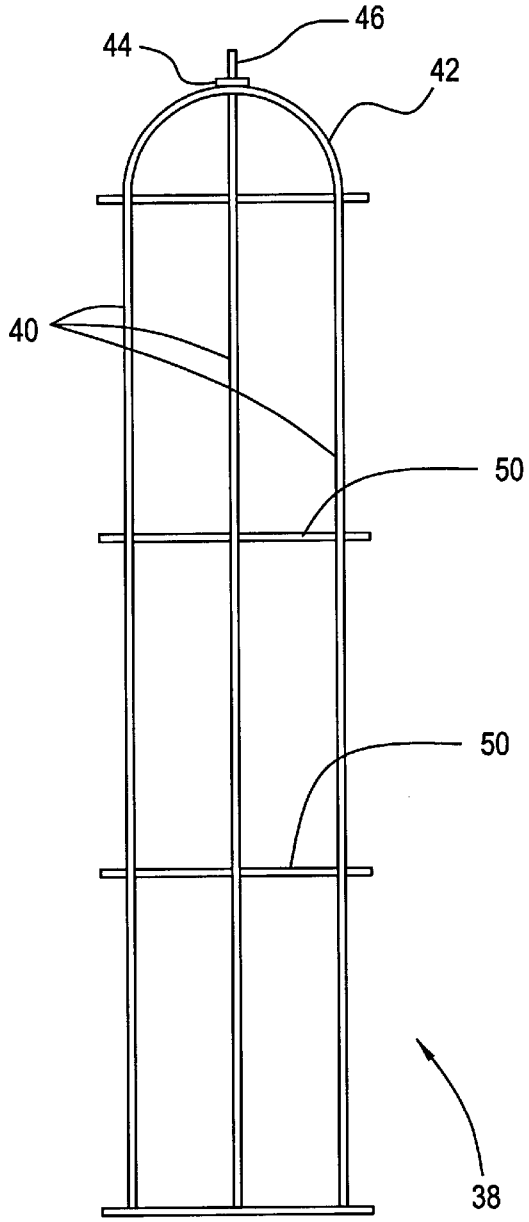
FIG. 3 shows a separate view of the grid of the illuminating device according to FIG. 2.
Figure 4:
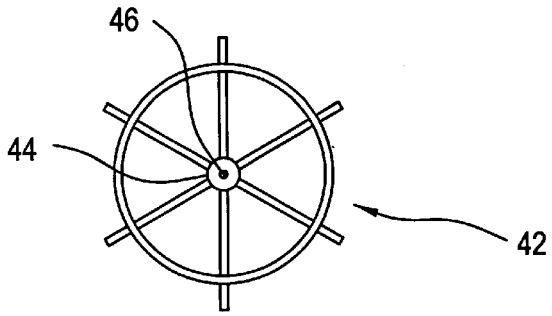
FIG. 4 is a top view of FIG. 3.

With reference to FIG. 1, an illuminating balloon 10 comprises a self-inflatable envelope 12 made of flexible material of small thickness containing an illuminating device 14 with an electric bulb 16, and a control unit 18 designed to supply the electrical power to the bulb 16 and the pneumatic energy to inflate the envelope 12 of the balloon 10. The material of the envelope 12 may be constituted, for example, by a, cloth, plastified cloth, or by a simple plastic film.

The envelope 12 presents an appreciably elliptical shape, the internal upper part being covered with a light-reflecting film. The base of the envelope 12 comprises an orifice equipped with a fixing flange 20 fitted by assembly means onto a support plate 22 of the control unit 18. The support plate 22 is equipped with a holding leg 24 extending out downwards, and equipped with retaining means 23 with ball-bearings capable of being inserted by clipping into a tubular pole or post 25 acting as support for the balloon 10. A reverse U-shaped bracket 26 is fixed onto the internal face of the support plate 22 to strengthen the mechanical rigidity of the support of the illuminating device 14.

The bracket 26 is covered by a bell-shaped insulating cover 28 forming a dielectric and thermal shield between the illuminating device 14 and the control unit 18. A washer 30 is placed between the bracket 26 and the top of the cover 28 to limit the thermal conduction between the grid 38 and the bracket 26. The illuminating device 14 bears directly on the upper face of the cover 28 and on the outside of the internal compartment of the latter.

The illuminating device 14 comprises an insulating spacer 32, notably made of poly-tetrafluorethylene, supported by the cover 28 and acting as support for a sleeve 34 for positioning of the bulb 16. The spacer 32 is provided with an internal bore for running of the electrical connecting wires 36 between the sleeve 34 and the control unit 18. The electric bulb 16 may be of the incandescence or halogen type, being formed by an elongate tube with double envelope of high electrical power, for example 1000 W.

The bulb 16 is arranged in the middle zone of the balloon 10 and extends along the minor vertical axis of the balloon 10, being surrounded coaxially by a cylindrical protective grid 38 preventing the envelope 12 from coming into contact with the bulb 16. The grid 38 is formed by a plurality of rigid metallic wires 40, for example made of stainless steel, extending at regular angular intervals along the generating lines of a cylinder. The wires 40 are curved at the level of the top part in order to constitute an armature 42 in the form of a spherical cap affixedly secured to a central washer 44 arranged along the minor axis in the direction of the bulb 16.

A stainless steel centering pin 46 is welded onto the washer 44 and is designed to be inserted into an orifice (not represented) provided at the upper part of the envelope 12. The end of the pin 46 is threaded and cooperates with a nut 48, tightening of which gives the balloon 10 rigidity, in particular along the minor axis of the elliptical envelope 12. The different metallic wires 40 of the grid 38 are joined to one another by cylindrical strengtheners 50 arranged coaxially with the holding leg 24 and staggered at regular intervals along the minor axis.

The control unit 18 inside the cover 28 is equipped with a pneumatic blowing device 52, for example a suction device or an electric fan with blades or turbine, designed to perform inflation of the envelope 12. The pneumatic inflation device 52 comprises an intake orifice 54 passing through the support plate 22 to suck air in from the outside, and a discharge orifice 56 to send the air under pressure to the inside of the envelope 12 by means of a hole provided in the cover 28.

The fan is driven by a very low voltage motor, for example 12V or 24V, which is supplied by an electronic circuit 58 associated to a step-down transformer connected to the main power supply by a power supply cable 59. A pressure detector 60 is adjoined to the wall of the cover 28 and cooperates with the electronic circuit 58 to interrupt the electrical power supply to the bulb 16 when the pressure of the air inside the envelope 12 drops below a preset threshold.

Assembly and operation of the illuminating balloon 10 are as follows:

The balloon 10 is transported ready-to-assemble, the envelope 12 being completely deflated and stowed in a case with the illuminating device 14 and the control unit 18.

Fitting of the grid 38 and of the control unit 18 and of the bulb 16 is performed after the assembly has been inserted via the bottom orifice of the envelope 12, followed by fixing of the grid 38 and flange 20 respectively to the upper part of the envelope 12 by tightening the nut 48 onto the threaded part of the pin 46, and to the support plate 22 on the bottom side.

The holding leg can then be inserted by clipping into an end piece of a pole or of any other supporting part. Inflation and illumination of the balloon 10 are controlled by powering on the electronic circuit 58, which first causes the pneumatic blowing device 52 to be put into operation resulting in automatic inflation of the envelope 12. Power supply of the bulb 16 for illumination of the balloon 10 is possible as soon as the air pressure inside the envelope 12 becomes sufficient.

The envelope 12 is not totally airtight, due to the presence of small outlet orifices, for example at the level of the seams 62 of the two semi-elliptical parts arranged along the large axis of the envelope 12.

The fan of the electropneumatic device 52 runs continuously when the lamp 16 is lit and keeps the envelope 12 in the inflated state even in the case of slight damage to the envelope 12 caused by accidental or intentional perforation.

Integrating the control unit 18 in the envelope 12 considerably simplifies the safety measures for protection of people against insulation faults, as the balloon 10 is located on a pole at a certain height above the ground. The user is not in direct contact with the control unit 18 and bulb 16 when the current supply plug is plugged into the main power socket.

The elliptical shape of the envelope 12 in the inflated state enables the illuminating range of the neighbouring zone to be increased, and the mechanical rigidity of the envelope 12 along the minor axis is particularly efficient for the resistance of the balloon to wind.

In addition to the pressure detector 60, the control unit 18 may be controlled by an adjustable light-detecting relay (not represented) to switch the balloon 10 on and off automatically.

In addition to the main power supply constituting the normal electrical power supply source, the electronic circuit 58 may in addition be supplied by a backup power source, for example an accumulator or batteries, arranged on the support plate 22 inside the cover 28. Should the AC main voltage supply become unavailable when a protective circuit breaker trips, the balloon 10 still remains operational, for the fan continues running to keep the envelope 12 in the inflated state. The backup time depends on the power of the backup source and can be extended by decreasing the light intensity of the bulb 16 during this intermittent phase to constitute an emergency lighting.

The backup source makes the balloon 10 fully autonomous, and it is kept in the charged state by means of a charger which can also be integrated in the cover 28.

I claim:

1. An illuminating balloon, comprising:

an inflatable envelope made of flexible material;

an illuminating device including an electric bulb;

first means for supporting and supplying power to the bulb;

second means for filling the envelope with a fluid to inflate the balloon;

wherein the first and second means are arranged in a control unit integrated in a base of the envelope and include:

an electropneumatic blowing device having an intake orifice to suck air in from outside of the envelope, and a discharge orifice to send the air into an internal space of the envelope;

an electronic circuit for power supply of the electropneumatic blowing device and of the bulb; and a cover for support of the bulb and a protective grid preventing the envelope from coming into contact with the bulb, said grid extending to the top of the envelope.

2. The illuminating balloon according to claim 1, wherein the control unit is mounted on a support plate which fits onto a fixing flange of the envelope, said flange defining a first orifice for insertion of the illuminating device and control unit into the internal space of the envelope.

3. The illuminating balloon according to claim 2, wherein the support plate includes a holding leg extending outwards from the envelope in a direction coaxial to the grid, and able to be fitted to a support element.

4. The illuminating balloon according to claim 3, wherein the holding leg includes securing means for clipping into an upper end piece of the support element.

5. The illuminating balloon according to claim 1, wherein the envelope is made of a cloth or film in an elliptical shape in the inflated state, the cover and grid extending along the minor axis of the envelope.

6. The illuminating balloon according to claim 1, wherein the protective grid includes a plurality of rigid metallic wires extending at regular angular intervals along the generating lines of a cylinder, the wires being curved at the top part in order to constitute an armature in the form of a spherical cap, affixedly secured to a central washer, which is provided with a centering pin designed to be positioned in a second orifice of the envelope, the end of the pin being threaded to cooperate with a tightening nut.

7. The illuminating balloon according to claim 2, wherein the cover is shaped as a bell fixed onto the support plate to form a dielectric and thermal shield between the illuminating device and the control unit.

8. The illuminating balloon according to claim 7, wherein the base of the bulb is housed in a sleeve supported by an insulating spacer bearing on the cover, the current input from the electronic circuit to the bulb by wires passing through a bore of the spacer.

9. The illuminating balloon according to claim 1, wherein the electropneumatic device is formed by a suction device or a fan driven by an electric motor put into operation as soon as the electronic circuit is powered on.

10. The illuminating balloon according to claim 1, wherein the electronic circuit is connected by an external cable to the main power supply constituting the normal power supply source, and is in addition supplied by a backup source arranged inside the cover.

* * * * *